US007114470B2

(12) United States Patent
Ramanathan et al.

(10) Patent No.: US 7,114,470 B2
(45) Date of Patent: Oct. 3, 2006

(54) SAFETY-CAP SYSTEM FOR AN ENGINE COOLING DEVICE AND A METHOD

(75) Inventors: Premkumar Ramanathan, Chennai (IN); Giri Prasad Rajagopal, Chennai (IN); Kumaresan Narayanaswamy, Chennai (IN)

(73) Assignee: Sundram Fasteners Limited, Chennai (IN)

( * ) Notice: Subject to any disclaimer, the term of this patent is extended or adjusted under 35 U.S.C. 154(b) by 0 days.

(21) Appl. No.: 11/080,486

(22) Filed: Mar. 16, 2005

(65) Prior Publication Data

US 2005/0211709 A1 Sep. 29, 2005

Related U.S. Application Data

(63) Continuation of application No. PCT/IN2003/000310, filed on Sep. 17, 2003.

(30) Foreign Application Priority Data

Sep. 18, 2002 (IN) ..... 692/02

(51) Int. Cl.
*F01P 3/22* (2006.01)
*B65D 55/00* (2006.01)
*B65D 51/16* (2006.01)

(52) U.S. Cl. ..... 123/41.54; 220/201; 220/203.1

(58) Field of Classification Search ..... 123/41.54; 220/201, 202, 203.1
See application file for complete search history.

(56) References Cited

U.S. PATENT DOCUMENTS 3,587,912 A 6/1971 Ohta

FOREIGN PATENT DOCUMENTS

DE 101 64 669 A1 7/2003
WO WO-95/32904 A1 12/1995

*Primary Examiner*—Noah P. Kamen
(74) *Attorney, Agent, or Firm*—Birch, Stewart, Kolasch & Birch, LLP

(57) ABSTRACT

The present invention provides a safety cap system with a pressure and temperature activated external locking cum unlocking means for an automotive cooling system to prevent accidental removal of the safety cap. The safety cap further uses a torque overriding mechanism to ensure an effective closure and removal torque.

21 Claims, 9 Drawing Sheets

VIEW 'E'

VIEW 'G'

FIG 9.1 INITIAL CONDITION

FINAL CONDITION FIG 9.2

FIG 9.3 INITIAL CONDITION

FINAL CONDITION FIG 9.4

FIG 9.5 INITIAL CONDITION

FINAL CONDITION FIG 9.6

SAFETY-CAP SYSTEM FOR AN ENGINE COOLING DEVICE AND A METHOD

BACKGROUND OF THE INVENTION

1. Field of the Invention

The present invention relates to a safety cap system with an external locking and unlocking element for an automotive cooling device, to prevent premature unlocking of the safety cap under abnormal pressure and temperature conditions. The present invention specifically relates to a safety cap with a torque overriding arrangement and a pressure and temperature controlled sensor to provide an effective locking and unlocking of the safety cap and a method thereof.

2. Description of the Background Art

With the advent of engines with increased horsepower, smaller radiators and higher thermostat opening temperatures, much more heat is accumulated in the engines of cars and other vehicles of today. These vehicles include trucks, LCVs, MCVs, vans, cars, snowmobiles, marine engines, off-road vehicles and sport utility vehicles. These vehicles have less engine surface to dissipate the heat into the atmosphere than older type of engines. To contain the excess heat build-up problem, the pressurized cooling system was developed. The radiator or any other safety-caps in these pressurized systems function to provide a safe opening so that liquid or any other suitable medium can be vented out and to maintain the desired system pressure.

Pressurized vessels are often provided with a closure cap or a valve which, when removed, allows the tank to release pressure and be filled with refilling coolant.

However, the premature removal of the closure cap subsequent to the pressurized vessel involves a sudden release of pressure when the cap is removed. This sudden release of pressure creates a dangerous situation resulting in expulsion of some liquid and steam from within the tank.

During operation, when an engine becomes very hot, the engine cooling fluid can reach a temperature as high as 118 to 129° C. and pressure levels as high as 110–117 kPa. (USA-NHTSA—Federal Register Vol 66 No.108 Jun. 1, 2001/Proposed rules). Under such high temperature and pressure conditions, the sudden release of pressure upon removal of the closure cap, subsequent to the pressurization of the reservoir is also dangerous to the effect that it may result in the cap of the cooling device getting blown off. In effect, the cap may become a dangerous projectile or a missile, thereby exposing the persons in the vicinity to the threat of serious bodily injuries, should the cap blow off the cooling device during the unscrewing operation and also spraying the persons close to the cooling device with the hot fluid or steam that is ejected.

Some of the conventional pressure cap units are so designed that once the pressure increases in the system it is capable of being removed when the cooling device is in hot condition. Under this condition the user is exposed to the risk of being injured by the highly pressurized cap and getting scalded from the steam jet that emerges out of the cooling device.

There have been numerous instances where the high-pressure steam or hot liquid is ejected out from the engine cooling system during cap removal process, thereby causing serious bodily injuries.

U.S. Pat. No. 4,927,049 teaches an internal thermally locking radiator cap for fitting on the filler neck flange of an automotive radiator, which prevents the radiator cap from becoming detached from the filler neck flange when the radiator is hot. The cap uses a bi-metallic strip captured on the top surface of the radiator cap and having an end that goes through the opening of the radiator cap and engages the filler neck flange to lock the cap in place.

U.S. Pat. No. 5,042,677 discloses a radiator cap with a safety plate or wire made of memory alloy. The safety plate or wire bends downward under ambient temperature. High temperature water in the radiator causes the safety plate to extend out due to the memory characteristic of the alloy and the safety plate thus presses against the neck of the filling hole.

One such provision to remove the excess pressure conditions before the cap is removed completely was disclosed in U.S. Pat. No. 5,603,425, wherein a radiator cap with sealing members is disclosed. However, the product covered under the above said patent has the following limitation that a user of this cap, while closing the cap, does not seem to receive any feedback to indicate that the cap has reached its desired torque limit; as result the cap can be tightened below the desired limits resulting in high installation torque and high removal of torque further leading to inconvenience to the operator using the cap. The tightening of the cap may result in improper seating of the small o-ring, which further leads to ineffective sealing thereby leading to pressure and coolant loss.

U.S. Pat. No. 6,378,717 discloses a closure cap without a ratcheting with an internal locking means with a temperature controlled element to prevent unscrewing of the cap when the heat in the reservoir is in excess levels. Further, an exclusive and special reservoir is required for the closure cap of this design. In addition, the instant design may not be adaptable to radiator application because of lack of controlled vent path and also due to loss of coolant.

In addition, closure caps of an engine cooling device, functioning on the basis of temperature sensing can fail to actuate the sensor if an end user tries to locally cool the cap by pouring cold water on the heated cap or the cap may fail to cooperate if a snow falls on the cap when the hood is kept opened for cooling.

SUMMARY OF THE INVENTION

In order to overcome the above-mentioned hazards of an engine cooling system, the primary object of the present invention is to provide a safety-cap system with a highly safe and pressure sensitive cap, which obviates the aforesaid drawbacks of the conventional ones.

An object of the present invention is to provide a safety-cap system, which is so designed that the safety-cap cannot be removed before the internal pressure of the associated cooling device has been completely released, whereby the danger of scald caused by a jet of steam or a bodily injury due to the ejection of safety cap is completely eliminated.

Another object of the present invention is to provide a safety-cap system for relieving the pressure in the cooling device, in a systematic manner by locking the safety cap beyond a certain pressure and temperature levels.

Yet another object of the present invention is to provide a safety-cap system for safety caps used in pressurized environments, more particularly to an improved safety cap on the cooling system of internal combustion engines.

Further object of the invention is to provide a safety-cap system that can cater to the needs of automatic lock and release mechanism of a safety cap of a cooling device, subject to pressure and temperature factors.

Still another object of the present invention is to provide a safety cap system with a torque overriding action to provide correct installation and removal torque.

The present invention provides a safety cap system with a pressure and temperature sensitive external locking and unlocking element for an automotive cooling device, to prevent premature unlocking of the safety cap. The present invention further provides a pressure and temperature controlled element or sensor to provide an effective locking and unlocking of the safety cap along with an overriding torque arrangement to provide and indicate exact installation and removal torque for the safety cap and a method thereof.

Accordingly, the present invention provides a safety cap system for engine cooling devices, the system comprising: a reservoir container with a neck for storing cooling material;

A safety cap system for engine cooling devices, the system comprising; a removable safety cap with torque overriding arrangement, coupled firmly to the neck of the reservoir container storing cooling material, the safety cap provided with a circumferential flange, at least an external locking and unlocking member, disposed on the reservoir container, in close proximity with the flange to engage or disengage the flange of the safety cap, said locking and unlocking member having a sealing arrangement, and a pressure and temperature sensitive metallic sensor helical sensor housed in the locking and unlocking member to sense variations in pressure and temperature levels of the cooling material and to effect the locking or unlocking of the safety cap.

In one embodiment of the present invention, the reservoir container is selected from a surge tank, radiator, de-gas tank and over flow tank.

In another embodiment of the present invention, the safety cap is made of metal and plastic material.

In another embodiment of the present invention, the safety cap is selected from a threaded cap, a bayonet-locking cap and a rotary cap.

In another embodiment of the present invention, the torque overriding arrangement is used to provide and indicate correct installation and removal torque to the user.

In a further embodiment of the present invention, the flange consists of grooves or blind cavities.

In another embodiment of the present invention, the external locking and unlocking element is a plunger device.

In another embodiment of the present invention, the plunger device further consists of an outer sleeve to house a movable shaft, a pressure and thermal sensor and a pin to act as a dead end support for the movable shaft.

In an embodiment of the present invention, the upper end of the outer sleeve is disposed close to the flange and the lower end with an opening is suspended in the reservoir container.

In still another embodiment of the present invention, the metallic sensor is a pressure and temperature sensitive metallic sensor having helical shapes, disposed in between the movable shaft and bottom pin.

In yet another embodiment of the present invention, the metallic sensor activates the movable shaft when the pressure and temperature levels in the reservoir container exceeds or reverts to a predetermined level thereby locking/unlocking the safety cap.

In still another embodiment of the present invention, the movable shaft of the plunger device on activation locks the flange of the safety cap thereby arresting the rotary motion of the safety cap, under elevated pressure and temperature conditions of the reservoir container.

In a further embodiment of the present invention, the movable shaft on activation unlocks the safety cap by retracting the shaft from the flange under normal pressure and temperature conditions, to facilitate the rotary movement of the safety cap.

In still another embodiment of the present invention, the outer sleeve of the plunger device has a configuration selected from threaded, push-type or snap-fit for an effective fitting of the plunger device to the reservoir container.

In yet another embodiment of the present invention, the suitable facial configuration of the plunger device is selected from hexagon, square, circular, wing type forms for an easy fitting of the plunger unit to the reservoir container.

In still another embodiment of the present invention, the plunger device is sealed by a shaft neck seal, shaft top seal, shaft cylinder seal, shaft outer seal, shaft inner seal and sleeve seal.

In yet another embodiment of the present invention, a pair of plunger devices can also be optionally disposed on either side of the reservoir container for an effective locking and unlocking of the safety cap.

In a further embodiment of the present invention, the system handles the coolant material selected from liquid and gaseous materials.

There is also an embodiment of the present invention, wherein a method for providing fail-proof safety cap system for engine cooling devices, comprises the steps of:

(a) closing the safety cap of the reservoir container by means of torque overriding arrangement;

(b) locking the safety cap externally by directing the movable shaft of the plunger device towards the flange of the safety cap, to arrest the rotary movement of the safety cap, whenever the pressure and temperature conditions in the reservoir container is above the normal levels; and (c) unlocking the safety cap, to facilitate the rotary movement after the pressure and temperature conditions return below the pre-determined limit.

In an embodiment of the present invention, the plunger unit gets activated when the pressure in the reservoir container exceeds a pressure level of 2 psi and thereby engages the locking mechanism of the safety cap.

In another embodiment of the present invention, the plunger unit disengages the locking mechanism of the safety cap when the pressure in the reservoir container is less than 2 psi.

In still another embodiment of the present invention, the proper seating of the safety cap is due to torque overriding arrangement of the safety cap, leading to an effective sealing of pressure and heat of the reservoir container.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by way of illustration only, and thus are not limitative of the present invention.

DETAILED DESCRIPTION OF THE PREFERRED EMBODIMENTS

Figure 1:
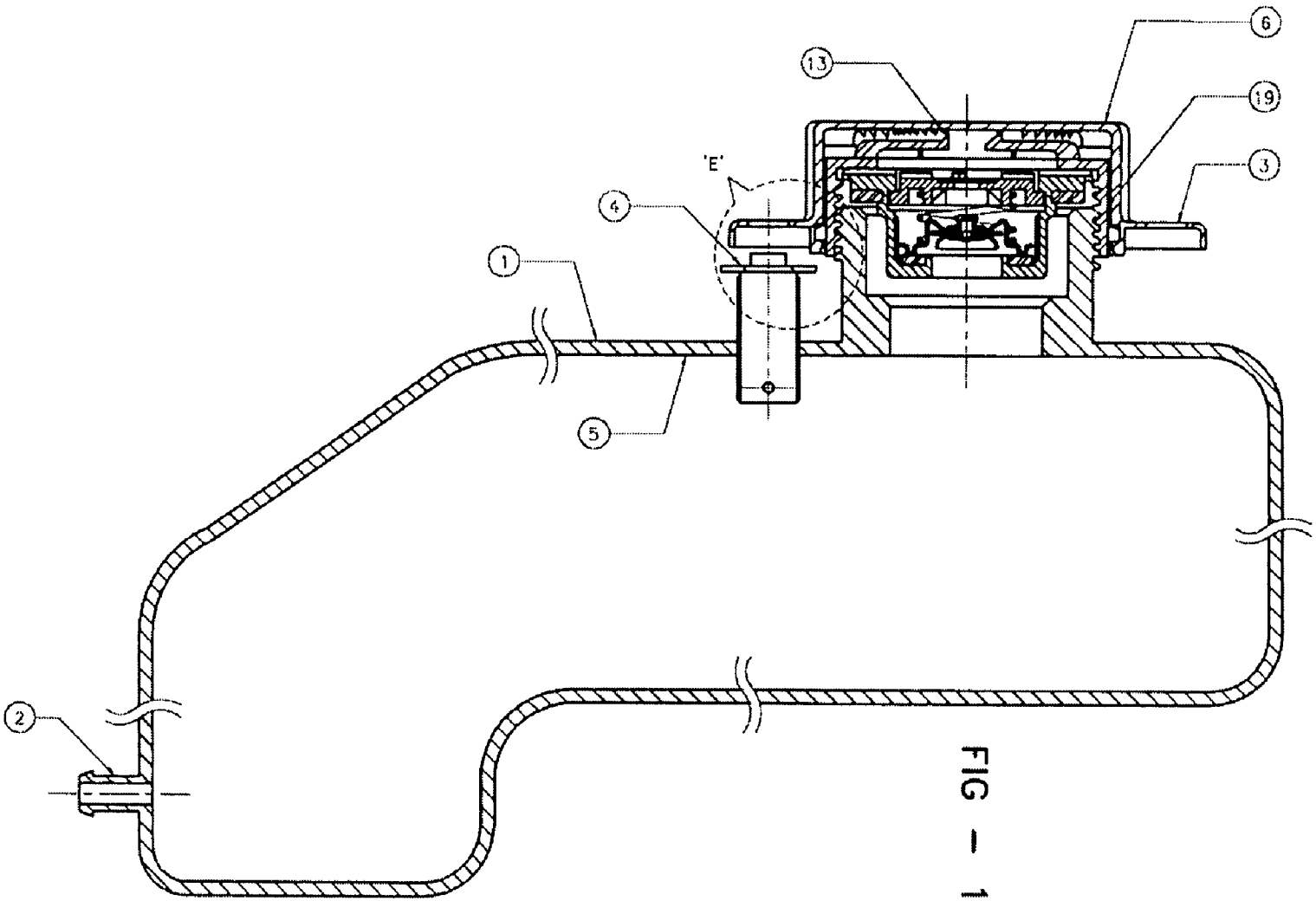
FIG. 1 is a sectional view of the safety cap with a flange along with a plunger device coupled to a reservoir container.
Figure 2:
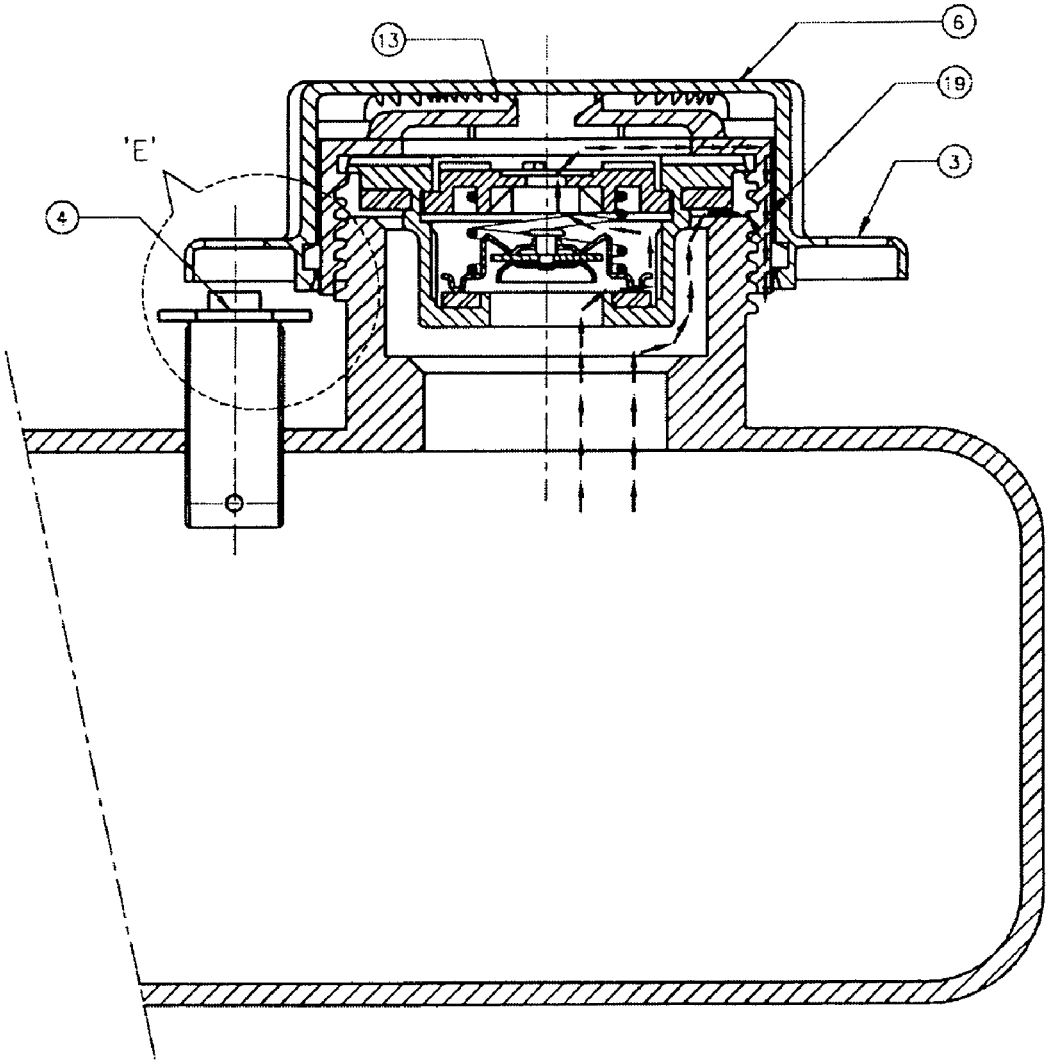
FIG. 2 is closer sectional view of the safety cap with a plunger device.

Referring initially to FIGS. 1 and 2, a removable safety cap (6) with a flange (3) is coupled with the neck (19) of the reservoir container (1), with a torque overriding arrangement (13) for an effective installation and removal torque. An inlet (2) circulates the coolant into the reservoir container. A plunger device (4), as locking and unlocking element for the safety cap is disposed and sealed to the reservoir wall (5) with one end projected towards the flange (3) of the safety cap (6) and other end extending into the reservoir container (1). The plunger device (4) effects the locking and unlocking of the safety cap under abnormal and normal conditions respectively. A vent path is provided between the neck (19) and the safety cap (6) for a steady release of residual levels of pressure and temperature during the removal of the safety cap.

Figure 3:
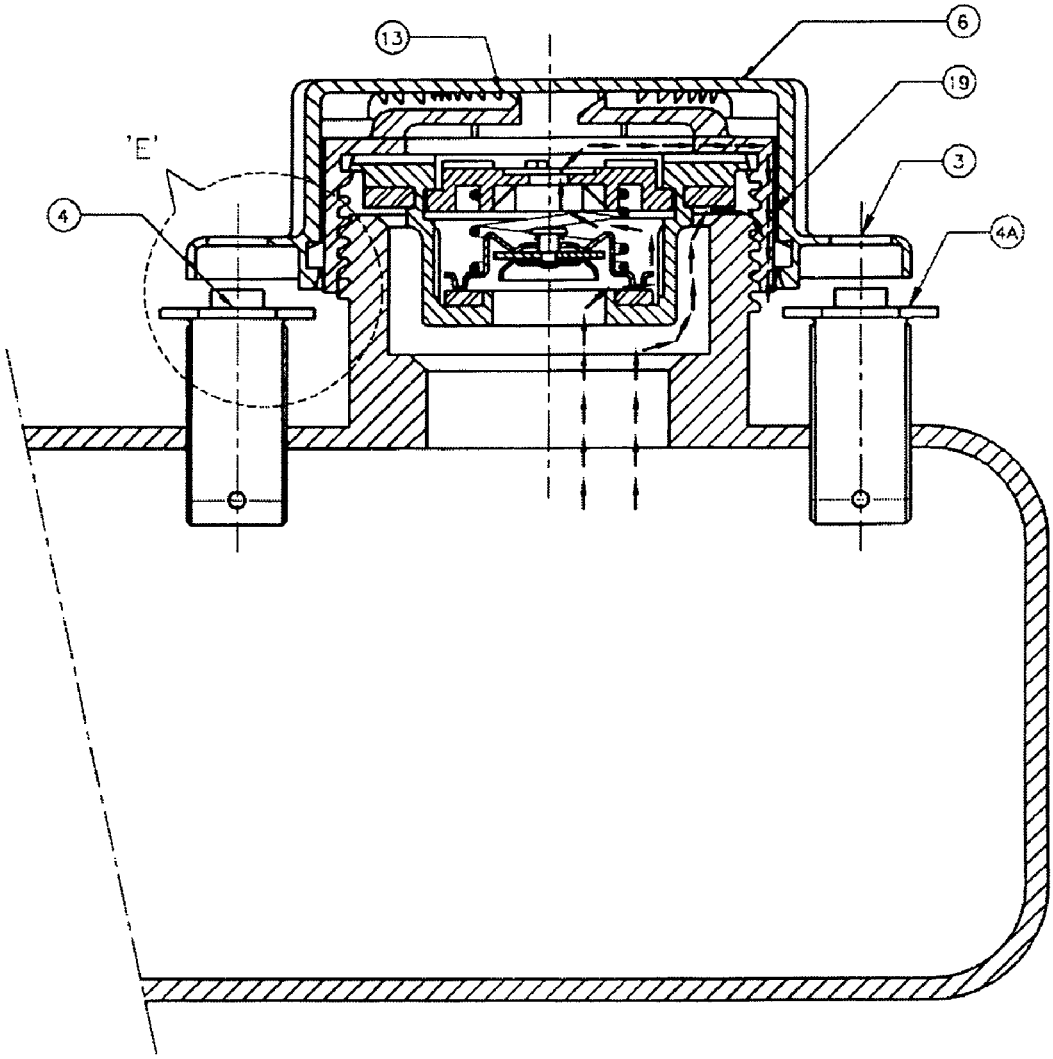
FIG. 3 depicts a pair of plunger devices disposed on either side of the safety cap.

In another exemplary embodiment of the present invention, as represented by FIG. 3 of the accompanied drawings, which is same as described in FIGS. 1 and 2, but differing in the area where a pair of plunger devices (4 and 4*a*) are disposed on either side of the safety cap (6) of the wall of the reservoir container for an effective locking and unlocking of the safety cap.

Figure 4:
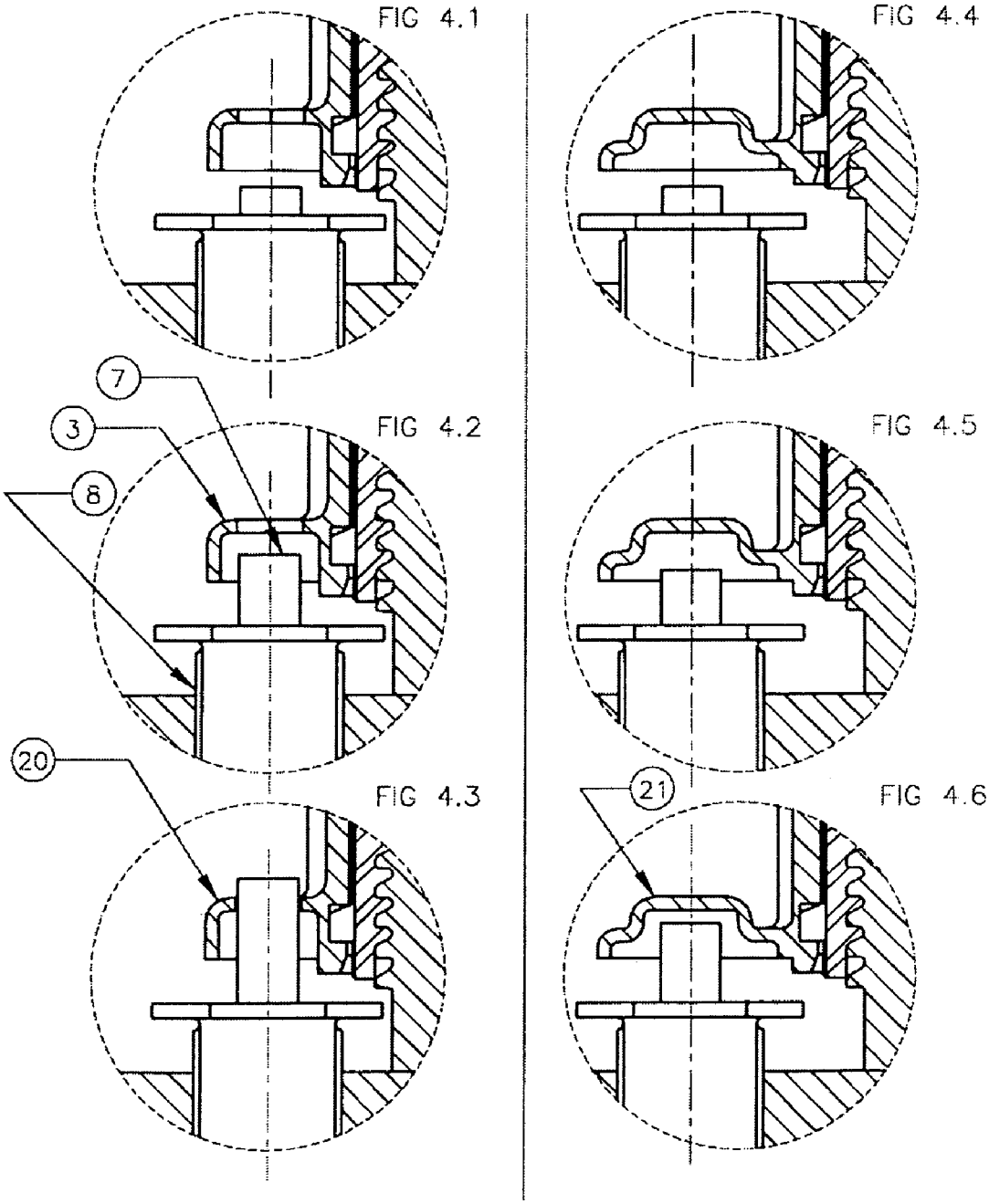
FIG. 4 is a cross section view of a plunger device with locking and unlocking element for the safety cap having grooves and blind cavities.

Now, referring to FIGS. 4.1, 4.2 and 4.3 of FIG. 4 of the accompanied drawings, wherein the working of the plunger device is depicted to clearly show the three stages viz., normal, locking and unlocking of the safety cap of the plunger device. When the safety cap (6) with grooves (20) is coupled to the neck (19) of the reservoir container (1), the movable shaft (7) that is disposed in the outer sleeve (8) of the plunger device is rested below the flange (3) of the safety cap (6) under normal pressure and temperature conditions. However, in the event of an increase in pressure, say for instance pressure levels more than 2 psi and/or temperature levels more than about 50° C. in the reservoir container (1) during the running of a vehicle, the movable shaft (7) is projected towards the flange (3) and passes through the grooves (20) and locks the flange (3) of the safety cap (6) to effectively arrest the rotary motion of the safety cap (6), thereby preventing the user from opening the cap. The movable shaft (7) will return to the normal position (FIG. 4.1) when the pressure and temperature conditions of the reservoir container (1) (by preventing the sensing of outside temperature such as hood temp. which is higher by 30–40° C. as compared to the coolant temperature) return to normal state to enable the user to remove the cap.

In another exemplary embodiment of the present invention as represented in FIGS. 4.5 and 4.6, the movable shaft (7) locks the flange (3) of the safety cap having blind cavities (21), whenever the pressure and temperature levels (as stated above) of the reservoir are above normal. Further, the movable shaft returns to the normal state as shown in FIG. 4.4 whenever the pressure and temperature conditions of the reservoir (1) return to a normal state.

Figure 5:
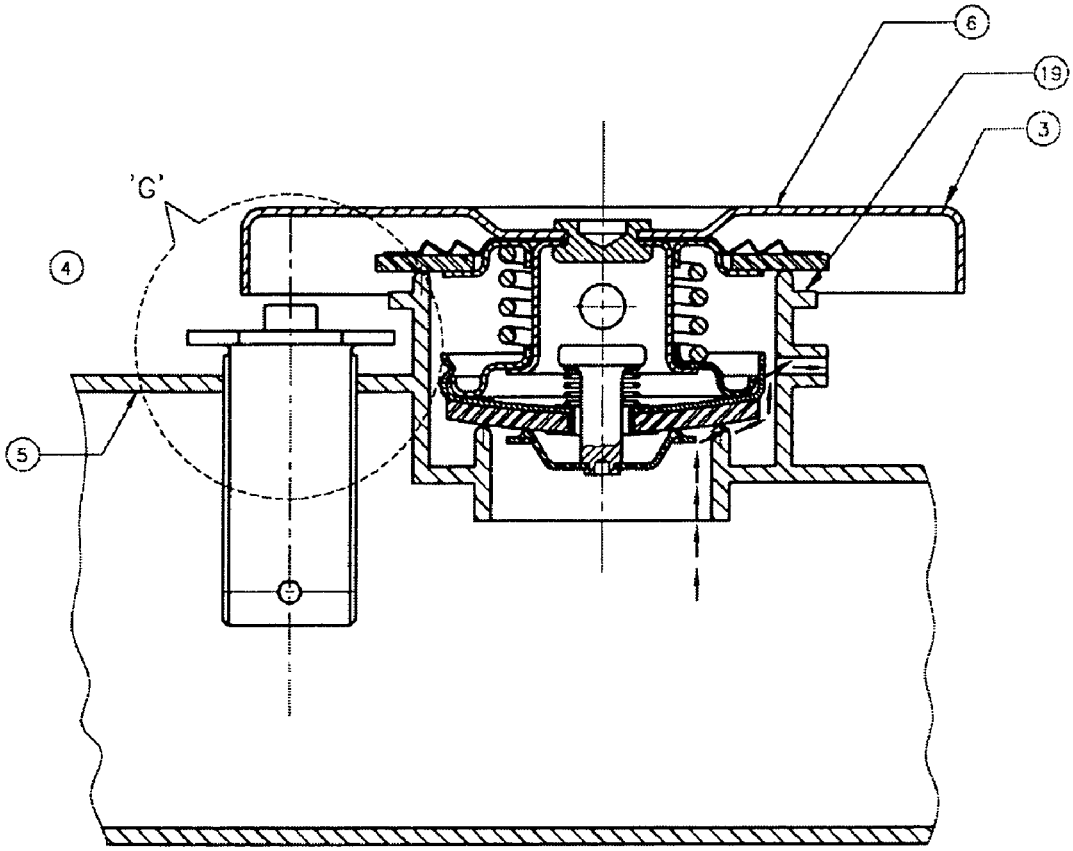
FIGS. 5 & 5A show a sectional view and an upper view of a metal cap with a plunger device.

In yet another exemplary embodiment of the present invention as represented in FIG. 5, a removable metallic safety cap (6) with a flange (3) having grooves is mounted on the neck (19) of the reservoir (1) (in the instant case, the reservoir is a radiator), to control the installation and removal torque of the safety cap (6). A plunger device (4) is disposed and sealed to the reservoir wall (5) with one end projected towards the safety cap (6) and other end extending into the reservoir (1).

Figure 5A:
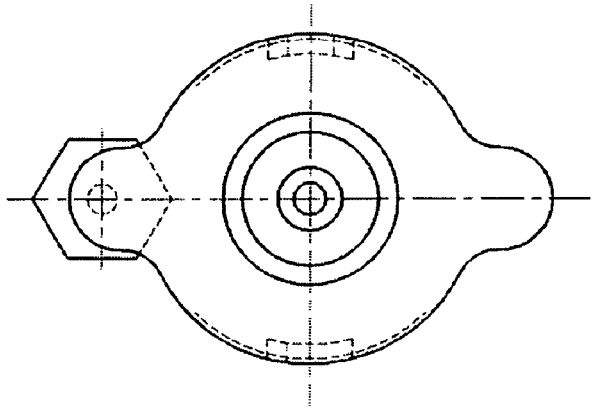

FIG. 5*a* provides an upper view of the metallic cap with a plunger locking the cap.

The working methodology of the metallic cap as shown in FIG. 5 is the same as that of the plastic cap.

Figure 6:
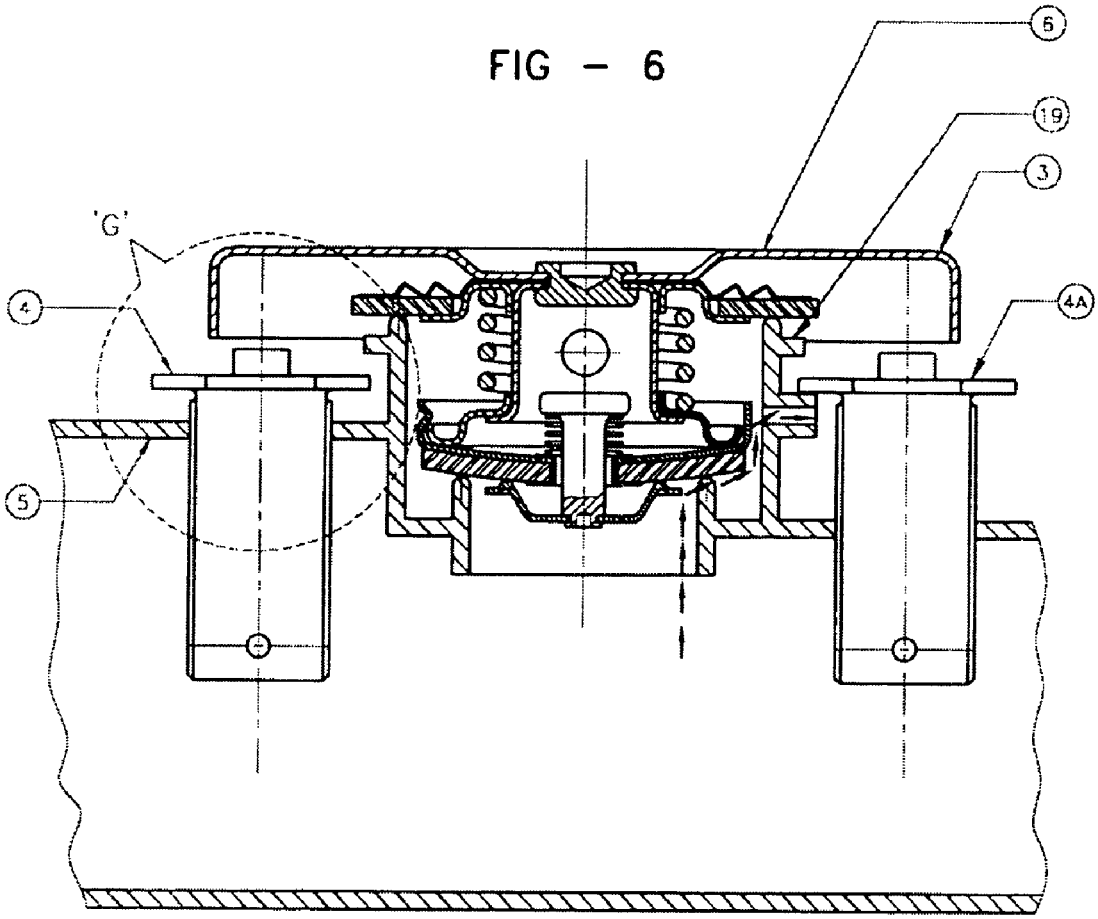
FIGS. 6 & 6A depict a view of metallic cap with a pair of plunger devices.
Figure 6A:
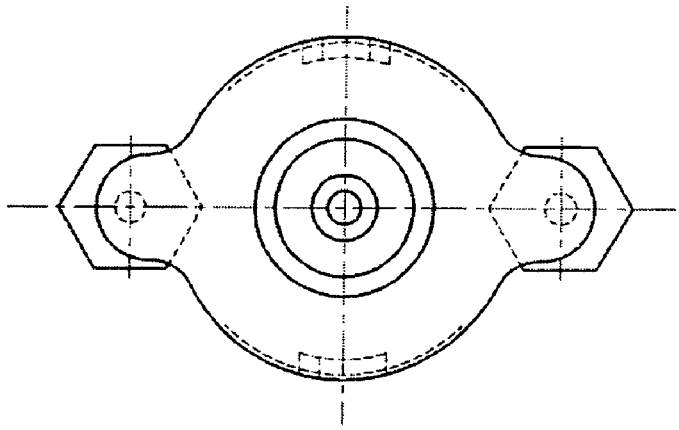

Another exemplary embodiment of the present invention, as represented by FIG. 6 of the accompanied drawings, is the same as described in FIGS. 1 and 2, but differs in the area where a pair of plunger devices (4 and 4*a*) are disposed on either side of the safety cap (6) of the wall of the reservoir container (1) for an effective locking and unlocking of the safety cap.

FIG. 6(*a*) of the accompanied diagram depicts an upper view of the metallic cap with a pair of plunger locking devices.

Figure 7:
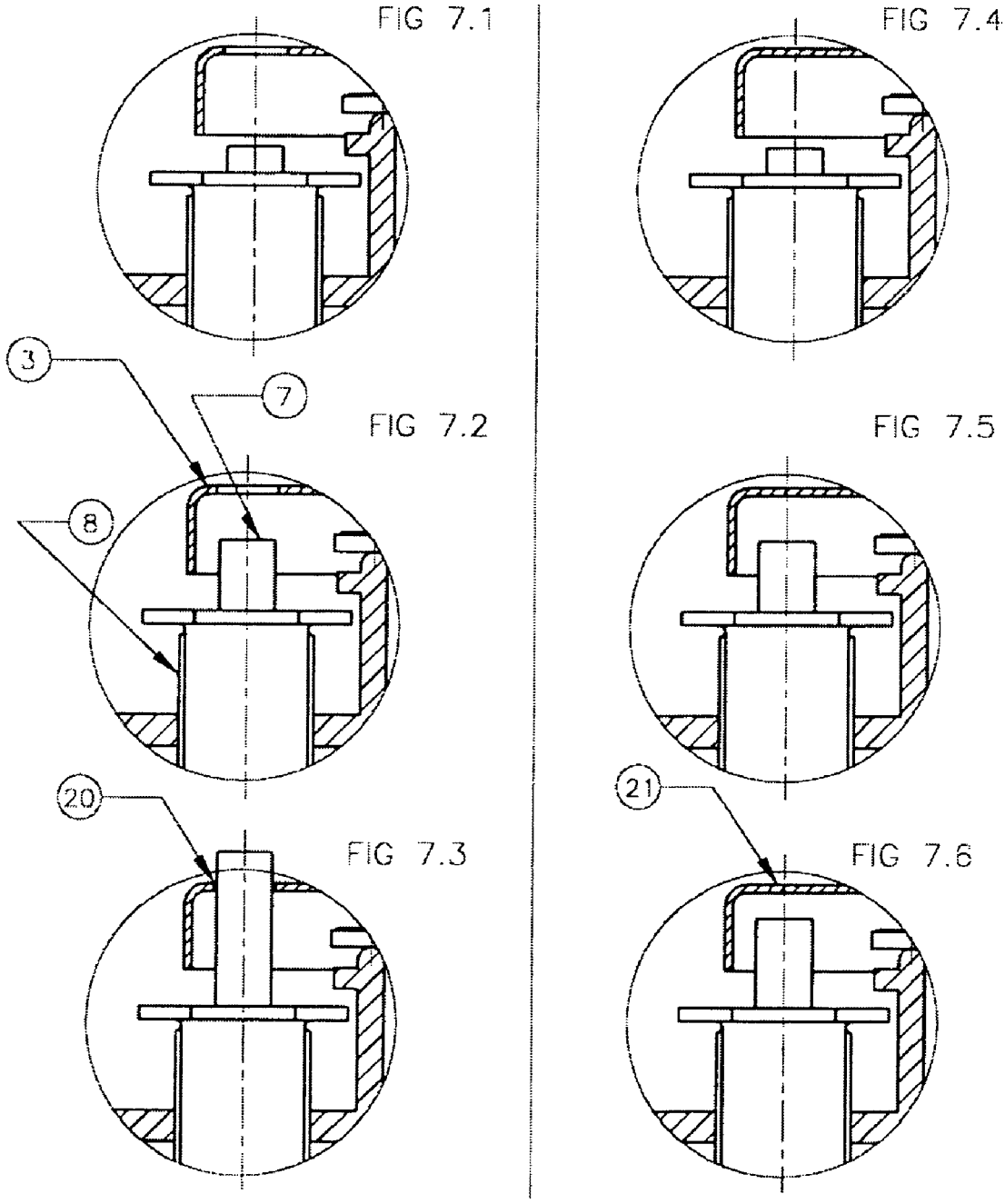
FIG. 7 provides a view on the functional aspects of the plunger device for a metallic cap with a flange having grooves and blind cavities.

In yet another exemplary embodiment of the present invention, as represented by FIG. 7 the functional aspects of the plunger device for a metallic cap is shown. The functional aspects of the plunger device for the metallic caps are similar to the description provided under FIG. 4.

Figure 8:
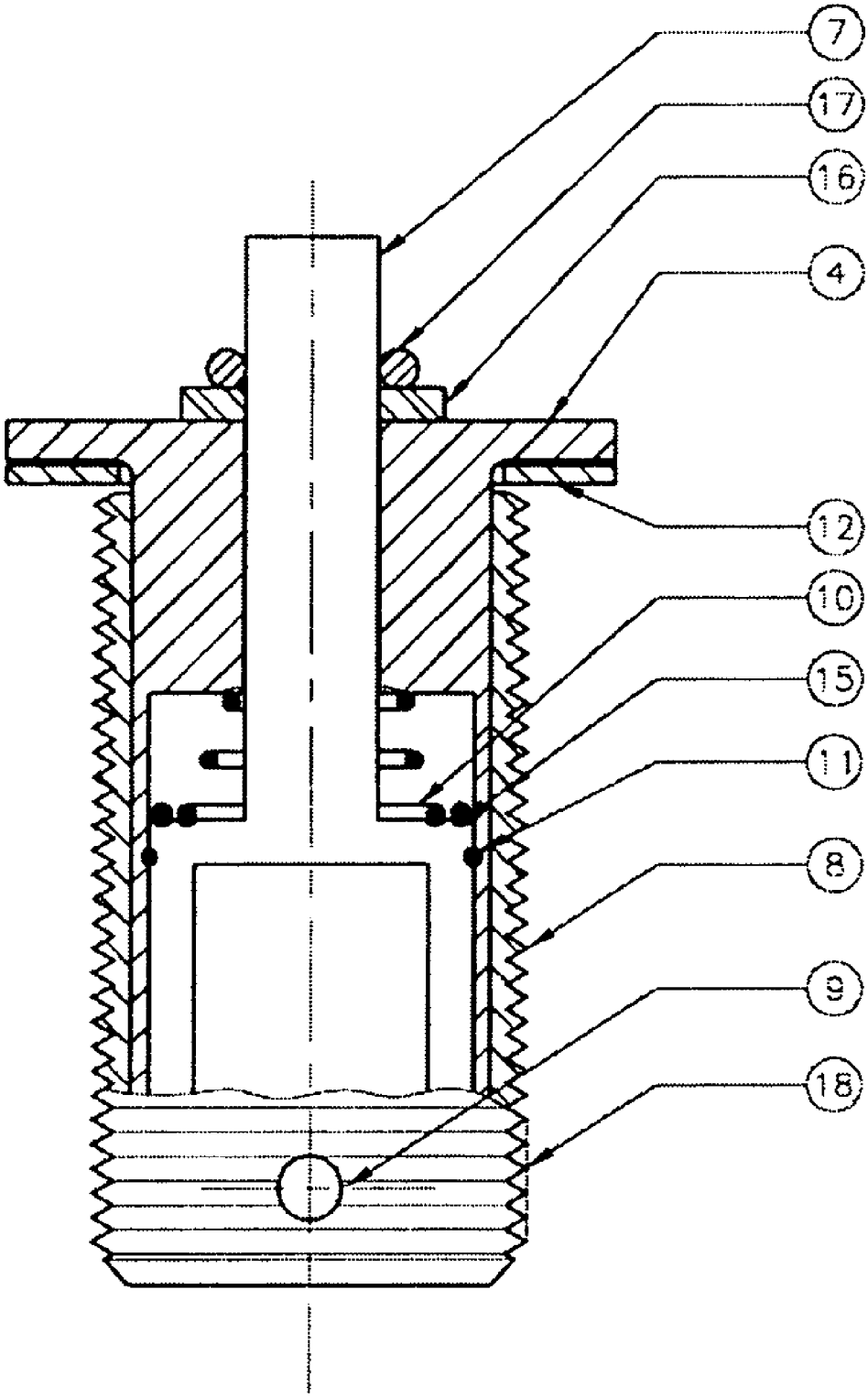
FIG. 8 provides a view of pressure and temperature sensing plunger device.

Now, referring to FIG. 8, a cross section of the plunger device is provided having a movable shaft (7) housed in the outer sleeve (8) of the plunger device that engages/disengages the flange (3) (not represented in this Figure) of the safety cap at predetermined pressure and temperature levels. Further, the outer sleeve (8) has a threaded, push type or snap fit configuration, preferably a threaded, to firmly dispose the plunger device to the reservoir container. Movable shaft (7) that is housed in the outer sleeve (8) supported at the lower end by a bottom pin (9) to provide a dead end stop the shaft (7). A pair of top seals (16 & 17) are disposed to prevent leakage of cooling material through the plunger device. Another aspect of the arrangement of the top seals (16 & 17) is that it prevents the inlet of air during the cooling cycle of the reservoir container. A shaft neck seal (12) is disposed at the neck of the plunger unit to have an effective sealing between the neck and the plunger unit, both during installation and operation of the plunger device. Shaft cylinder seal (11) and shaft inner seal (15) are located on the shaft (7) near the metallic strip sensor (10) to provide effective sealing to avoid the loss of coolant and air during operating conditions. Yet another sleeve seal (18) is provided on the outer periphery of the plunger device (4) to act as a sealing means to avoid the coolant and air loss between the reservoir container and the plunger device.

Figure 9:
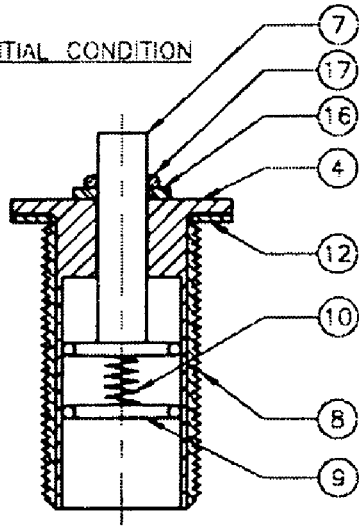
FIG. 9 is a functional view of the plunger device with pressure and temperature sensing metallic sensors.
Figure 9:
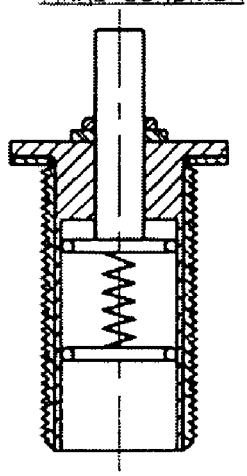
Figure 9:
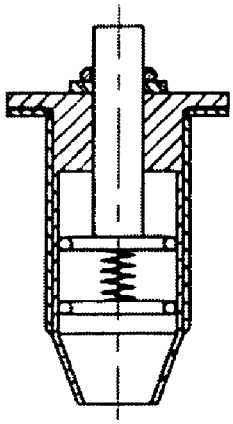
Figure 9:
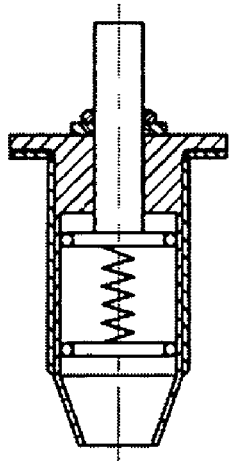
Figure 9:
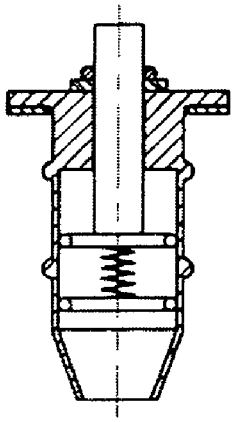
Figure 9:
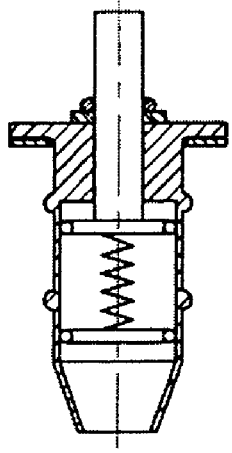

Now referring to FIG. 9, the working of the plunger device is shown in various stages of operation. A pressure and temperature sensor in the form of metallic strip sensor (10) is disposed in the free space between the bottom pin (9) and the shaft (7) to provide linear motion to the shaft during predetermined conditions of pressure and temperature levels of the reservoir container. The metallic strip sensor (10) is preferably in a helical form which is thermally and physically sensitive to react. When pressure and temperature conditions within the reservoir container are at certain predetermined levels due to the running of an engine, the resultant temperature/pressure is transmitted to the plunger unit, which is sensed by the metallic strip sensor (10), which expands and projects movable shaft (7) towards the flange (3) of the safety cap (not shown in this diagram) and locking the safety cap. Once the temperature/pressure conditions return to less than the predetermined conditions the shaft (7) retracts as a result of retraction of the metallic strip sensor and releases the lock of the safety cap.

The selected metallic sensor material of the present invention can sense pressure variations from about 2 psi and temperature variations from about 50° C.

The safety cap system of the present invention can be adapted to safety caps selected from O ring caps, coolant caps, radiator caps and other conventional caps for coolant devices, both made of plastic and metal.

The novel features of the present invention are further explained as follows:

A safety cap for the cooling device of an engine serves as a part of a coolant recovery system. The safety-cap is designed to hold pressure and vent the excess pressure. The so called venting characteristic of the cap directs the pressurized substance through the vent tube into a contiguously oriented drain channel and thus prevent any accident like drenching or scalding the attendant.

The present invention relates to a pressure cap unit with pressure locking element, which is applied for engines selected from trucks, vans, snowmobiles, marine engines, off-road vehicles and sport utility vehicles.

The Radiator Cap system of the present invention, having a torque overriding arrangement or mechanism provides following benefits:

The ratcheting action provides correct installation torque and correct removal torque, thereby the Cap is not tightened beyond desired limits, further leading to the convenience of the operator using the cap. The ratcheting action further provides proper seating of the small o-ring, for effective sealing to prevent pressure loss from the system. The user of the present system is also provided with proper feedback given in terms of feel and sound indicating that the cap has reached its full tight position.

ADVANTAGES

1. The locking mechanism of the present invention locks the safety cap from being removed by the end user during the periods of dangerously high pressure thus meeting the proposed standards of Department of Transport—National Highway Traffic Safety Administration, USA (NHTSA)
2. The system of the present invention can be retrofitted easily to the existing coolant systems of the various internal combustion automotives.
3. The locking and unlocking system of the present invention is lighter and does not add much weight to the system.
4. Adaptation of the system of the present invention results in substantial de-escalation of injury claims.
5. The system of the present invention does not require major modifications/alterations of the connected systems and subsystems.

We claim:

1. A safety cap system for engine cooling devices, said system comprising:

(a) a removable safety cap with torque overriding means, coupled firmly to the neck of a reservoir container storing cooling material, said safety cap provided with a circumferential flange;

(b) at least an external locking and unlocking element, disposed on the reservoir container, in close proximity with the flange to engage or disengage the flange of the safety cap, said locking and unlocking element having a sealing arrangement; and (c) a pressure and temperature sensitive metallic helical sensor housed in said locking and unlocking element to sense variations in pressure and temperature levels of the cooling material and to effect the locking or unlocking of the safety cap.

2. The safety cap system of claim 1, wherein the safety cap is a plastic or metallic.

3. The safety cap system of claim 1, wherein the safety cap is a threaded cap.

4. The safety cap system of claim 1, wherein the reservoir container is a radiator.

5. The safety cap system of claim 1, wherein the circumferential flange includes grooves or blind cavities.

6. The safety cap system of claim 1, wherein the external locking and unlocking element is a plunger device.

7. The safety cap system of claim 6, wherein the plunger device includes an outer sleeve with a suitable configuration to house a movable shaft, the pressure and temperature sensitive metallic sensor, a bottom pin to act as a dead end support for the movable shaft and a sealing arrangement.

8. The safety cap system of claim 7, wherein upper end of the outer sleeve is disposed in proximity with the flange and its lower end with an opening suspended in the reservoir container.

9. The safety cap system of claim 7, wherein the pressure and temperature sensitive metallic sensor is disposed between the movable shaft and the bottom pin.

10. The safety cap system of claim 7, wherein the metallic sensor is disposed to activate the movable shaft when the pressure and temperature levels in the reservoir container exceeds or reverts to a predetermined level thereby locking/unlocking the safety cap.

11. The safety cap system of claim 7, wherein the movable shaft is disposed to lock the flange of the safety cap thereby arresting the rotary motion of the safety cap, under elevated pressure and temperature conditions of the reservoir container.

12. The safety cap system of claim 7, wherein the movable shaft is disposed to unlock the flange of the safety cap by retracting the shaft from the flange under normal pressure and temperature conditions, to facilitate the rotary movement of the safety cap.

13. The safety cap system of claim 7, wherein the configuration of the outer sleeve of the plunger device is threaded.

14. The safety cap system of claim 7, wherein the facial configuration of the plunger device is hexagon.

15. The safety cap system of claim 7, wherein the sealing arrangement is shaft neck seal, shaft top seal, shaft cylinder seal, shaft inner seal and sleeve seal.

16. The safety cap system of claim 7, wherein a pair of plunger devices is disposed on either side of the reservoir container for an effective locking and unlocking of the safety cap.

17. The safety cap system of claim 1, wherein the coolant material is a gas or liquid.

18. A method of providing a fail-proof safety cap system for engine cooling devices, said method comprising the steps of:

(a) coupling the safety cap to a reservoir container of a cooling device and tightening it effectively by torque overriding means;

(b) locking the safety cap externally by directing the movable shaft of a plunger device towards a flange of the safety cap, to arrest the rotary movement of the safety cap, whenever pressure and temperature conditions in the reservoir container are above normal levels; and (c) unlocking the safety cap, to facilitate rotary movement after the pressure and temperature conditions return below the pre-determined limit.

19. The method of claim 18, wherein the plunger device is disposed to lock the safety cap when the pressure in the reservoir container exceeds a pressure level of above 2 psi.

20. The method of claim 18, wherein the plunger device is disposed to unlock lock the safety cap when the pressure in the reservoir container drops below a pressure level of less than 2 psi.

21. The method of claim 18, wherein the effective sealing of pressure and heat of the reservoir container is performed by proper seating of the safety cap with a torque overriding mechanism.

* * * * *

UNITED STATES PATENT AND TRADEMARK OFFICE

CERTIFICATE OF CORRECTION

PATENT NO. : 7,114,470 B2
APPLICATION NO. : 11/080486
DATED : October 3, 2006
INVENTOR(S) : Premkumar Ramanathan et al.

It is certified that error appears in the above-identified patent and that said Letters Patent is hereby corrected as shown below:

On the Title Page
The Foreign Application Priority Data should read as follows:

(30) Foreign Application Priority Data

Sep. 18, 2002 (IN).....692/MAS/2002

Signed and Sealed this

Third Day of April, 2007

JON W. DUDAS
*Director of the United States Patent and Trademark Office*